US006208262B1

(12) United States Patent
Jones

(10) Patent No.: US 6,208,262 B1
(45) Date of Patent: Mar. 27, 2001

(54) FLOOR CONDITION SENSOR

(75) Inventor: Thaddeus M. Jones, Bremen, IN (US)

(73) Assignee: MSX, Inc., South Bend, IN (US)

( * ) Notice: Subject to any disclaimer, the term of this patent is extended or adjusted under 35 U.S.C. 154(b) by 0 days.

(21) Appl. No.: 09/323,581

(22) Filed: Jun. 1, 1999

(51) Int. Cl.[7] ..... G08B 23/00

(52) U.S. Cl. ..... 340/693.5; 340/584; 340/604; 340/693.12; 439/449; 439/472

(58) Field of Search ..... 340/693.5, 604, 340/605, 584, 599, 693.6, 693.9, 693.12; 439/472, 942, 449

(56) References Cited

U.S. PATENT DOCUMENTS 3,986,110 * 10/1976 Overall et al. ..... 324/61 R
4,135,151 * 1/1979 Rogers et al. ..... 324/61 R
4,679,160 * 7/1987 Whitener ..... 364/563
4,765,187 * 8/1988 Weinstein ..... 73/304 R
4,766,369 * 8/1988 Weinstein ..... 324/61 R
4,805,070 * 2/1989 Koontz et al. ..... 361/286
4,897,597 * 1/1990 Whitener ..... 324/693
4,935,725 * 6/1990 Turnau ..... 340/568
5,006,969 * 4/1991 Lai ..... 362/206
5,886,256 * 3/1999 DeAnna ..... 73/170.26
5,995,003 * 11/1999 Rogers ..... 340/568.4

* cited by examiner

*Primary Examiner*—Daniel J. Wu
*Assistant Examiner*—Phung Nguyen
(74) *Attorney, Agent, or Firm*—Taylor & Aust, P.C.

(57) ABSTRACT

A floor sensor assembly includes a receptacle having at least one first electrical contact and a first substantially flat surface partially defining a floor surface. A sensor device is detachably secured to the receptacle and includes at least one second electrical contact electrically connected to the at least one first electrical contact of the receptacle. At least one of a temperature sensor and a moisture sensor is electrically connected to the at least one second electrical contact. The sensor device also includes a second substantially flat surface partially defining the floor surface. At least one electrical conductor is electrically connected to the at least one first electrical contact of the receptacle.

19 Claims, 5 Drawing Sheets

FLOOR CONDITION SENSOR

BACKGROUND OF THE INVENTION

1. Field of the Invention

The present invention relates to sensor devices and, more particularly, to sensor devices for detecting moisture and/or temperature.

2. Description of the Related Art

Sensor devices are used to sense temperature and the presence of moisture in an ambient environment. Such sensors can be elevated above ground level in order to detect temperature and precipitation, in liquid or frozen form, in an outside ambient environment. However, it would be difficult to use such sensors to detect temperature and the presence of moisture on a floor surface, which would require the sensors to be embedded directly in the floor surface. The sensors could easily become damaged and malfunction when subjected to the forces that are typically exerted on a floor surface. Should such damage or malfunction occur in an embedded sensor, the entire sensor assembly would need to be extracted from the floor, since each sensor assembly is formed as single, self-contained unit. The reinstallation of a new sensor assembly would require that the surrounding floor surface be repaired, which may include grouting or concrete work. Further, the wiring leading to the sensor assembly, which would also need to be embedded under the floor surface, may also need to be removed and replaced, thereby requiring more work on the surrounding flooring.

Another problem is that a sensor assembly may not have a flat surface which may be mounted at the same level as an existing floor. The sensor assembly also may not have a thickness which allows the sensor assembly to be mounted at the same level as the existing floor. In either case, the sensor assembly would present a depression or projection when mounted in the floor, thereby creating a tripping hazard for nearby pedestrians.

Yet another problem is that known sensor assemblies do not have a size and shape which fits in well between the surrounding tiles of a floor. Thus, gaps in the flooring would be created between the sensor assembly and the surrounding tiles, and such gaps would be problematic to fill in.

SUMMARY OF THE INVENTION

The present invention provides a tile-shaped floor sensor assembly including a receptacle which is permanently installed in a tile floor. The receptacle has a central cavity for receiving a sensor device which can be easily removed and replaced if it becomes damaged or defective.

The invention comprises, in one form thereof, a floor sensor assembly including a receptacle having at least one first electrical contact and a first substantially flat surface partially defining a floor surface. A sensor device is detachably secured to the receptacle and includes at least one second electrical contact electrically connected to the at least one first electrical contact of the receptacle. At least one of a temperature sensor and a moisture sensor is electrically connected to the at least one second electrical contact. The sensor device also includes a second substantially flat surface partially defining the floor surface. At least one electrical conductor is electrically connected to the at least one first electrical contact of the receptacle.

An advantage of the present invention is that the floor sensor assembly can be mounted in a floor, and, if the sensor device should become damaged or defective, it can be easily removed and replaced without disturbing the existing flooring.

Another advantage is that the floor sensor assembly has the size and shape of a tile and can therefore be easily incorporated into a tile floor without creating a safety hazard.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
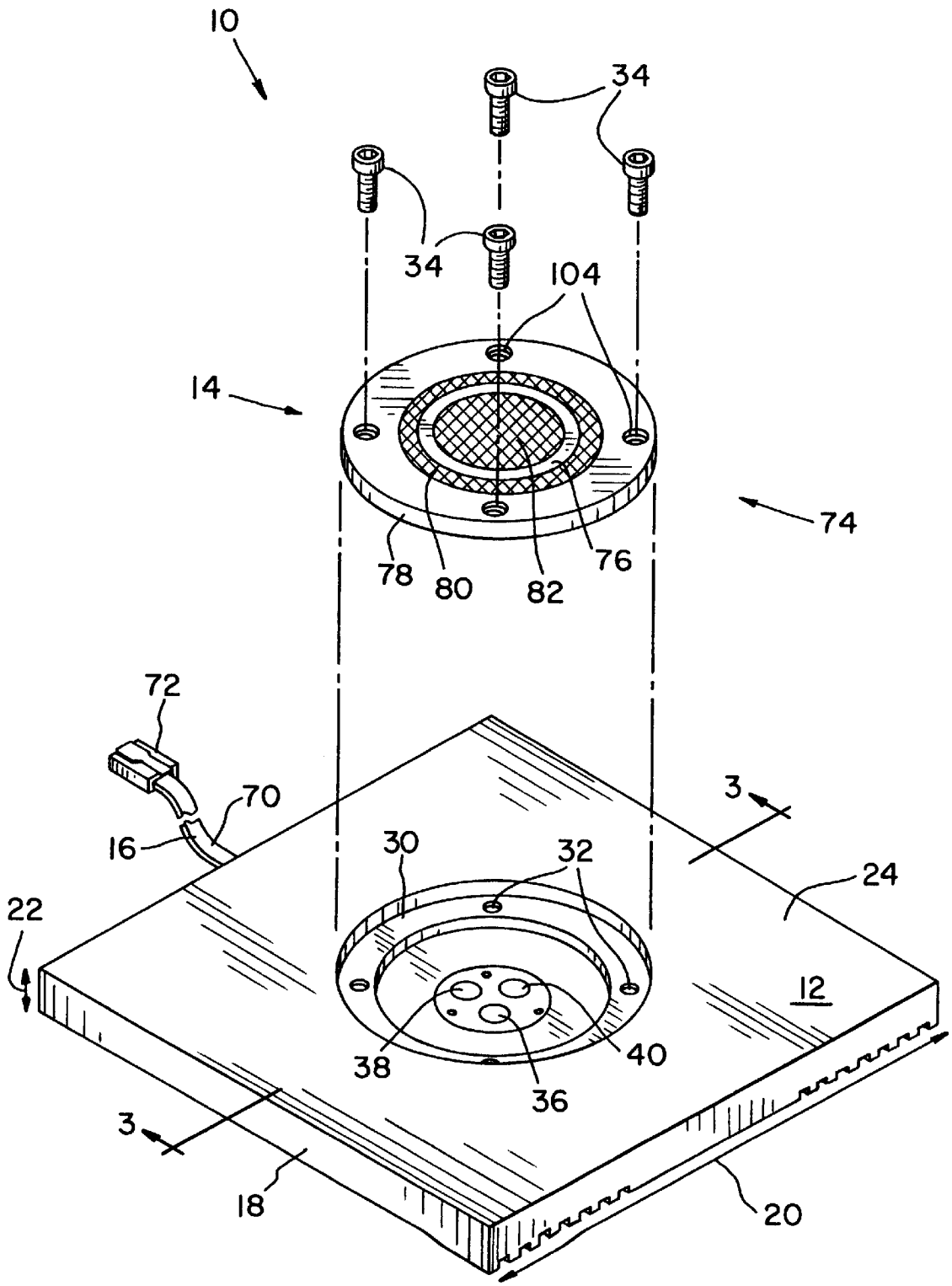
FIG. 1 is a top, perspective, partially exploded view of one embodiment of a floor sensor assembly of the present invention.

Referring now to the drawings, and particularly to FIG. 1, there is shown a floor sensor assembly 10 including a receptacle 12, a sensor device 14 and an electrical cable 16.

Figure 2:
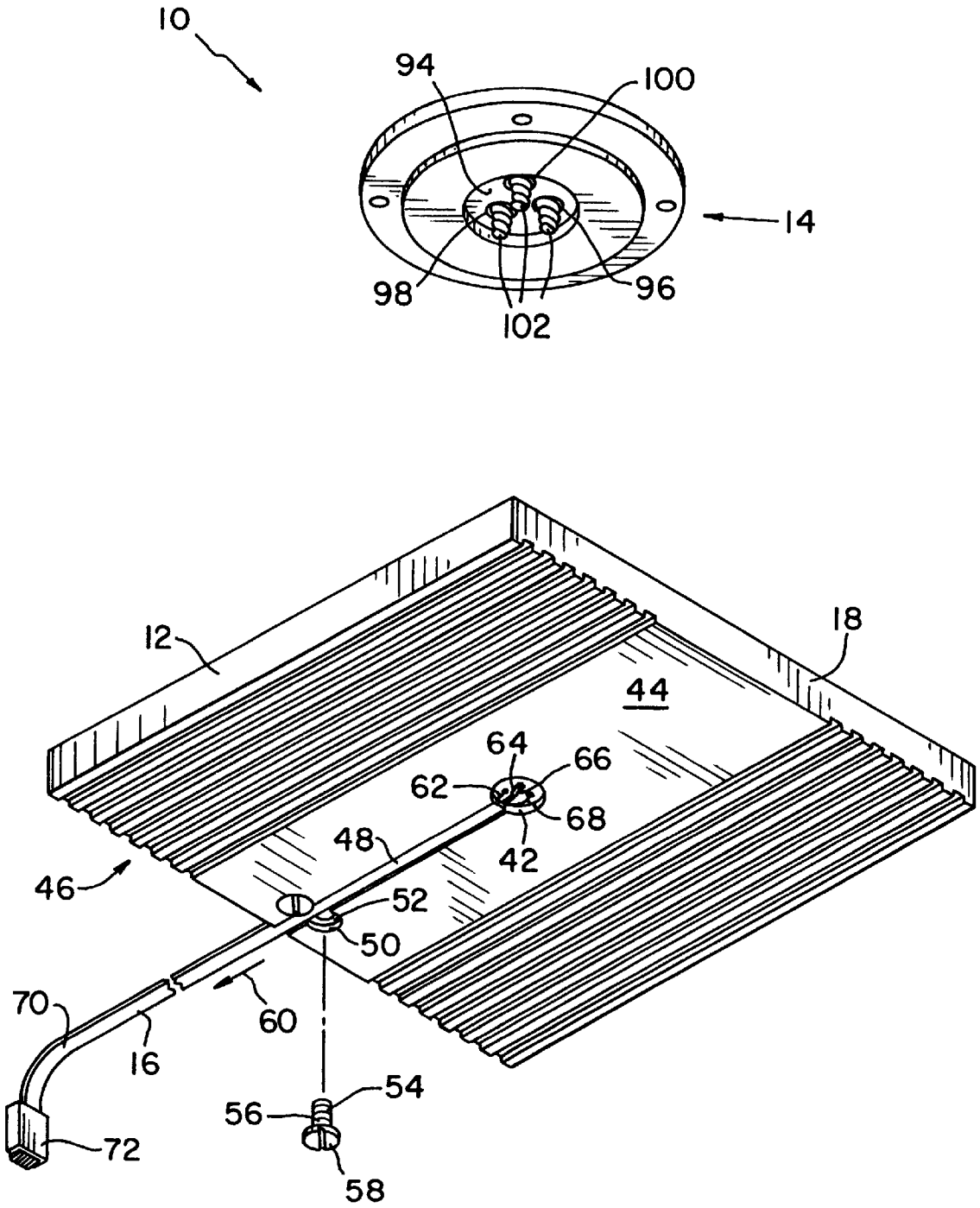
FIG. 2 is a bottom, perspective, partially exploded view of the floor sensor assembly of FIG. 1.
Figure 3:
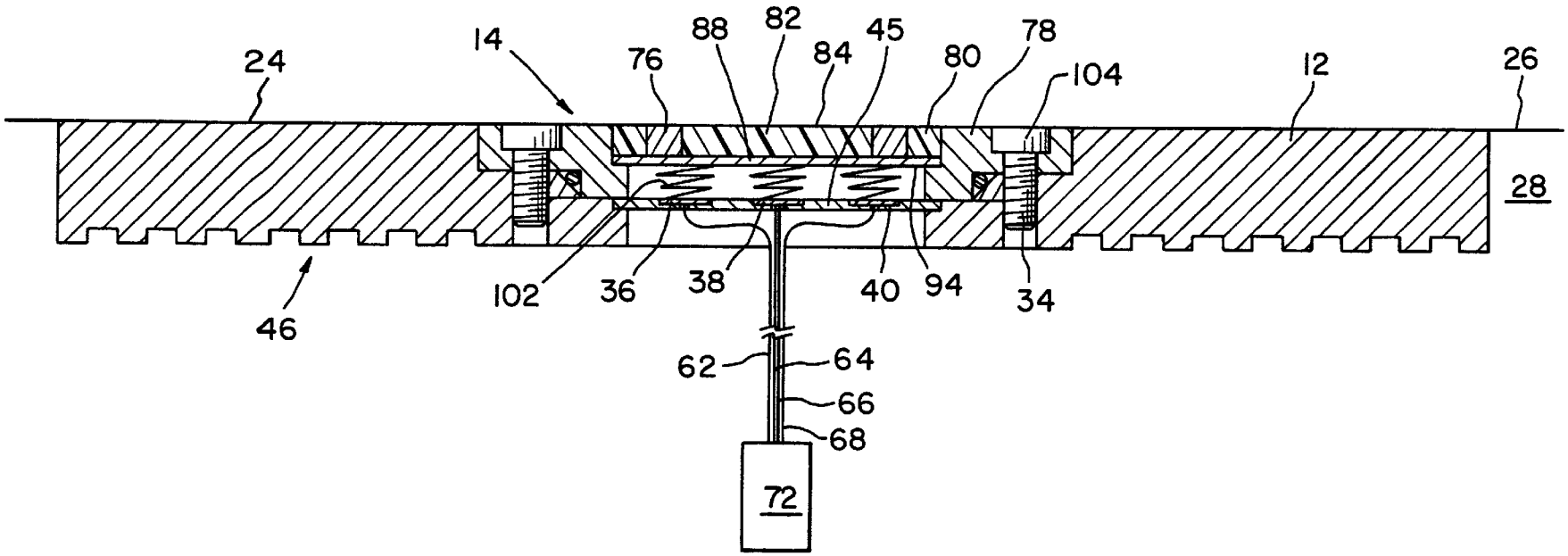
FIG. 3 is a side, sectional view of the floor sensor assembly of FIG. 1.
Figure 4:
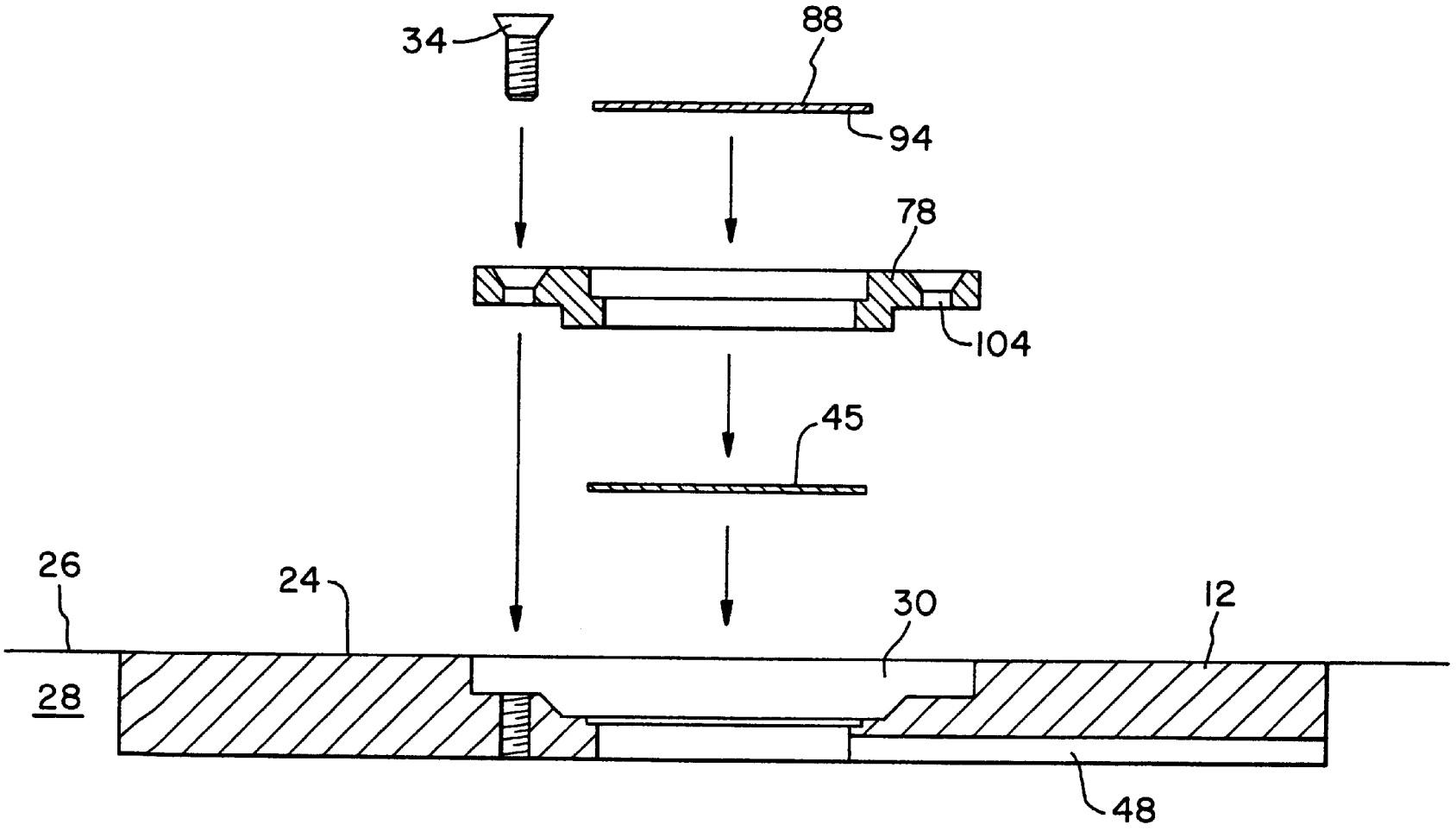
FIG. 4 is a partial, side, sectional, exploded view of the floor sensor assembly of FIG. 1.

Receptacle 12 is substantially square-shaped, with each side 18 having a length 20 of approximately between four and eight inches, and preferably approximately six inches. Receptacle 12 has a thickness 22 of approximately between 0.25 inch and 0.5 inch, and preferably approximately 0.375 inch. Thus, receptacle 12 has approximately the same size and shape as a conventional floor tile. A substantially flat top surface 24 of receptacle 12 is substantially flush or coplanar with a surface 26 of a surrounding floor 28, as best seen in FIGS. 3 and 4. Top surface 24 includes a cavity 30 for receiving sensor device 14. Cavity 30 includes four screw holes 32 which allow sensor device 14 to be detachably secured or removably attached to receptacle 12 with four respective screws 34. Cavity 30 also includes three exposed electrical contacts 36, 38 and 40 which are electrically connected to cable 16 through an opening 42 in a bottom surface or underside 44 (FIG. 2) of receptacle 12. Contacts 36, 38 and 40 are disposed on a printed wiring board 45 embedded in receptacle 12. Opening 42 can be filled with epoxy (not shown) in order to secure cable 16 in place within opening 42.

Mortar/concrete tension grooves 46 enable receptacle 12 to better adhere to the grout, mortar or concrete in the floor 28 in which receptacle 12 is mounted. A channel 48 receives cable 16, thereby protecting cable 16 from damage that might otherwise result from bearing the weight of receptacle 12 and from partially absorbing any forces that may be exerted on top surface 24 of receptacle 12. A widened portion 50 of channel 48 includes two threaded screw holes 52 which each receive a threaded shaft 54 of a respective screw 56. Respective nylon heads 58 of screws 56 can be rotated until heads 58 clamp cable 16 against channel 48. Heads 58 can be provided with widths such that heads 58 almost touch each other, which would spread the clamping force exerted by heads 58 over a maximum surface area of cable 16. In this way, screws 56 provide strain relief, which prevents cable 16 from being pulled out of receptacle 12 by a force in the direction of arrow 60.

Cable 16 includes four electrical conductors 62, 64, 66 and 68, with conductors 64 and 66 being grounded. A jacket 70, formed of polyvinyl chloride or another type of plastic, surrounds and protects conductors 62, 64, 66 and 68. At a distal end of cable 16, conductors 62, 64, 66 and 68 are connected to a modular jack 72 in the form of an RJ-45 connector. Through connector 72, an electrical controller (not shown) measures the electrical characteristics of sensor device 14 and, based upon these electrical characteristics, controls a resistive heater (not shown) embedded in floor 28.

Sensor device 14 includes a moisture sensor 74 in the form of an inner brass ring 76 and an outer brass ring 78 separated by a layer of epoxy 80. As best seen in FIG. 3, outer brass ring 78 forms a housing for sensor device 14. Along with a central epoxy core 82, rings 76, 78 and layer 80 provide sensor device 14 with a substantially flat top surface 84. Top surface 84 is substantially flush or coplanar with top surface 24 of receptacle 12 and with the remainder of surface 26 of floor 28 when sensor device 14 is attached to receptacle 12. Thus, each of top surfaces 24 and 84 partially defines surface 26 of floor 28. The electrical resistance of epoxy layer 80 varies with the level of moisture present on top surface 84. More particularly, the resistance of epoxy layer 80 decreases with an increasing level of moisture on top surface 84.

Figure 5:
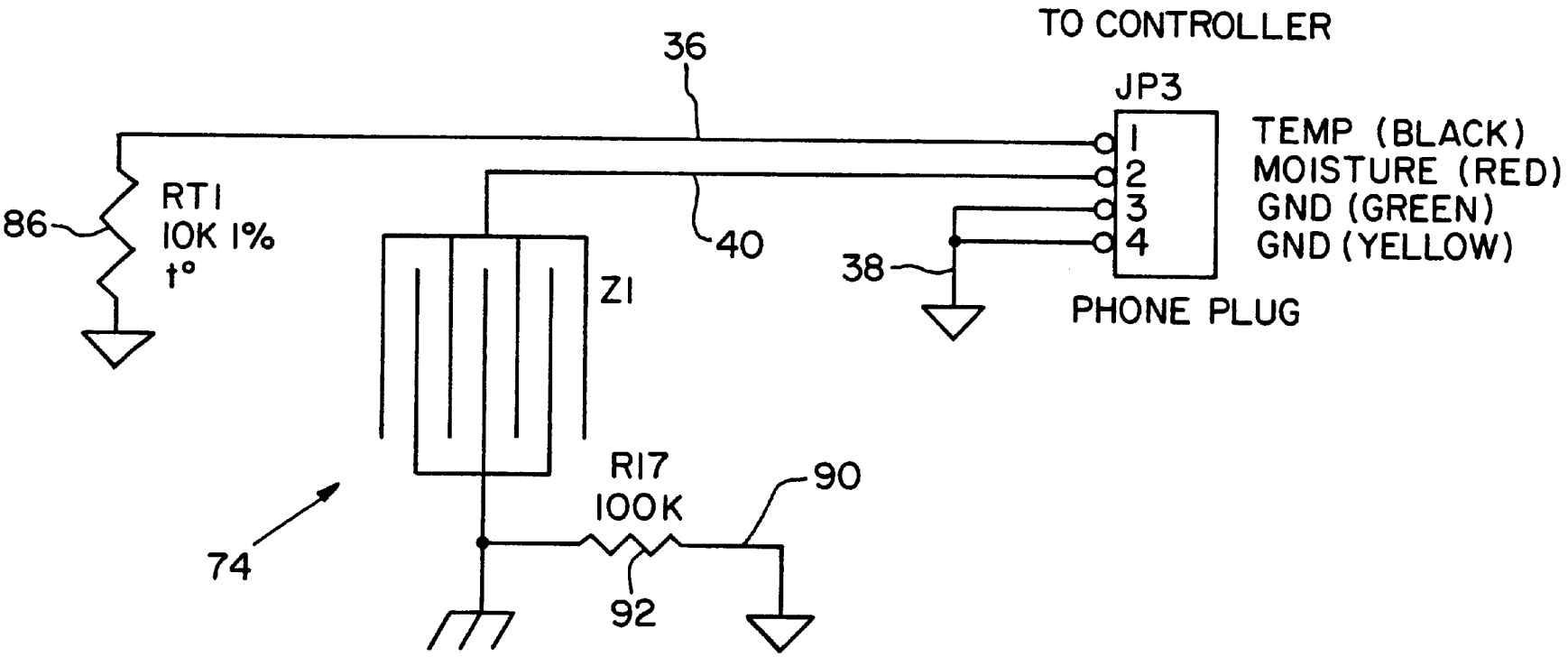
FIG. 5 is a schematic diagram of the floor sensor assembly of FIG. 1.

A temperature sensor 86 (FIG. 5) is in the form of a temperature-sensing resistor which is disposed on a printed wiring board 88. The electrical resistance of resistor 86 increases with temperature. Wiring board 88 also includes a ground wire 90 and a resistor 92 which electrically connect sensor housing 78 with ground. Resistor 92 prevents potentially destructive currents from flowing in ground wire 90. Potential sources for the destructive ground current include the magnetic field of other nearby current-carrying conductors and operating electric motors.

A bottom surface 94 of wiring board 88 includes three exposed electrical contacts 96, 98 and 100, with contact 98 being connected to ground through grounded contact 38 on receptacle 12. One of contacts 96 and 100 is connected to temperature-sensing resistor 86, while the other one of contacts 96 and 100 is connected to inner ring 76 of moisture sensor 74. Three conical springs 102 provide a self-aligning electrical interconnection between respective contacts 96, 98 and 100 on sensor device 14 and contacts 36, 38 and 40 on receptacle 12. Springs 102 are shown as being attached to contact pads 96, 98 and 100. However, it is also possible for springs 102 to be attached to contacts 36, 38 and 40, or to not be attached to any of contacts 36, 38, 40, 96, 98 and 100.

Sensor device 14 includes four through holes 104 through which sensor device 14 can be removably attached to receptacle 12 with screws 34. Screw holes 32 of receptacle 12 and through holes 104 are nonsymmetrically positioned or unevenly spaced to thereby provide a keying arrangement which allows sensor device 14 to be secured to receptacle 12 in only one desired rotational orientation. That is, all four through holes 104 simultaneously align with respective screw holes 32 in only one rotational position along the 360° arc of possible rotational positions.

During use, sensor device 14 is subject to being damaged from the forceful impacts to which floor surfaces are typically occasionally exposed. If sensor device 14 should become damaged or defective, due to impacts or another reason, the present invention allows sensor device 14 to be removed and replaced quite easily. More particularly, after screws 34 are removed, springs 102 push sensor device 14 upward so that it can be easily lifted out of cavity 30. A replacement sensor device 14 is then inserted into cavity 30 and screws 34 are screwed into screw holes 32 through through holes 104. In replacing sensor device 14, there is no need to remove receptacle 12 from floor 28. Thus, the flooring surrounding receptacle 12 is not disturbed and there is no need to repair the flooring with grout, mortar or concrete work.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A floor sensor assembly comprising:

at least one electrical conductor; and a receptacle including:

at least one first electrical contact electrically connected to said at least one electrical conductor; and a first substantially flat surface configured for partially defining a floor surface;

a sensor device detachably secured to said receptacle said sensor device including:

at least one second electrical contact electrically connected to said at least one first electrical contact of said receptacle;

at least one of a temperature sensor and a moisture sensor electrically connected to said at least one second electrical contact;

a second substantially flat surface configured for partially defining the floor surface; and an underside having a channel configured for receiving said at least one electrical conductor; said channel including at least one threaded screw hole and at least one screw having a shaft and a head, said shaft of each said screw being received in a respective said screw hole, said head of said at least one screw clamping said at least one electrical conductor against said channel.

2. The floor sensor assembly of claim 1, wherein said underside of said receptacle has a plurality of tension grooves.

3. The floor sensor assembly of claim 1, wherein said at least one electrical conductor includes a first end and a second end, said first end being electrically connected to said at least one first electrical contact of said receptacle, said second end being electrically connected to a modular jack.

4. The floor sensor assembly of claim 1, further comprising at least one spring electrically interconnecting said at least one first electrical contact of said receptacle and said at least one second electrical contact of said sensor device.

5. The floor sensor assembly of claim 4, wherein each said spring is attached to one of a first electrical contact and a second electrical contact.

6. The floor sensor assembly of claim 1, wherein said receptacle includes a cavity, said sensor device being received in said cavity.

7. The floor sensor assembly of claim 1, wherein said at least one electrical conductor includes a grounded conductor, said sensor device including a housing and a resistor electrically interconnecting said housing and said grounded conductor.

8. A floor sensor assembly, comprising:

a receptacle including:

at least one first electrical contact; and a first substantially flat surface configured for partially defining a floor surface;

a sensor device detachably and removably secured to said receptacle, said sensor device including:

at least one second electrical contact electrically connected to said at least one first electrical contact of said receptacle;

a second substantially flat surface configured for partially defining the floor surface; and at least one of a temperature sensor and a moisture sensor electrically connected to said at least one second electrical contact, said at least one of a temperature sensor and a moisture sensor including a moisture sensor having a layer of epoxy disposed between two electrically conductive elements, said layer of epoxy at least partially defining said second substantially flat surface of said sensor device; and at least one electrical conductor electrically connected to said at least one first electrical contact of said receptacle.

9. The floor sensor assembly of claim 8, wherein said receptacle includes an underside having a channel configured for receiving said at least one electrical conductor.

10. The floor sensor assembly of claim 8, wherein said receptacle includes at least one screw hole and said sensor device includes at least one through hole, each said through hole of said sensor device being aligned with a respective said screw hole of said receptacle.

11. The floor sensor assembly of claim 10, wherein said at least one screw hole includes a plurality of screws holes, said screw holes being nonsymmetrically disposed such that said sensor device can be screwed to said receptacle in only one orientation.

12. The floor sensor assembly of claim 8, wherein said floor sensor assembly has a thickness of approximately between 0.25 inch and 0.5 inch.

13. The floor sensor assembly of claim 8, wherein said layer of epoxy has an electrical resistance which varies with a level of moisture on said second substantially flat surface of said sensor device.

14. The floor sensor assembly of claim 8, wherein said two electrically conductive elements comprise two concentric rings at least partially defining said second substantially flat surface of said sensor device.

15. A method of sensing at least one of temperature of a floor and moisture on the floor, said method comprising the steps of:

providing a receptacle having a first substantially flat surface with a cavity, at least one first electrical contact being exposed in said cavity;

electrically connecting at least one electrical conductor to said at least one first electrical contact;

mounting said receptacle and said at least one electrical conductor in the floor such that said first substantially flat surface is substantially coplanar with a surface of the floor;

placing a sensor device in said cavity of said receptacle such that at least one second electrical contact of said sensor device is electrically connected to said at least one electrical contact of said receptacle, a second substantially flat surface of said sensor device being substantially coplanar with said first substantially flat surface of said receptacle;

detachably securing said sensor device to said receptacle;

removing said sensor device from said receptacle after said sensor device becomes at least one of damaged and defective; and installing a replacement sensor device in said cavity of said receptacle;

wherein said receptacle remains mounted in the floor throughout said removing and installing steps.

16. A floor sensor assembly comprising:

at least one electrical conductor;

a receptacle including:

at least one first electrical contact electrically connected to said at least one electrical conductor;

an underside having a channel and a clamping device, said channel being configured for receiving said at least one electrical conductor, said clamping device being configured for clamping said at least one electrical conductor against said channel; and a first substantially flat surface configured for partially defining a floor surface; and a sensor device detachably and removably secured to said receptacle, said sensor device including:

at least one second electrical contact electrically connected to said at least one first electrical contact of said receptacle;

at least one of a temperature sensor and a moisture sensor electrically connected to said at least one second electrical contact; and a second substantially flat surface configured for partially defining the floor surface.

17. A floor sensor assembly, comprising:

a receptacle including:

at least one first electrical contact; and a first substantially flat surface configured for partially defining a floor surface;

a sensor device detachably and removably secured to said receptacle, said sensor device including:

at least one second electrical contact electrically connected to said at least one first electrical contact of said receptacle;

a second substantially flat surface configured for partially defining the floor surface; and at least one of a temperature sensor and a moisture sensor electrically connected to said at least one second electrical contact, said at least one of a temperature sensor and a moisture sensor including a layer of epoxy at least partially defining said second substantially flat surface; and at least one electrical conductor electrically connected to said at least one first electrical contact of said receptacle.

18. A method of sensing at least one of temperature of a floor and moisture on the floor, said method comprising the steps of:

providing a receptacle having a first substantially flat surface with a cavity, at least one first electrical contact being exposed in said cavity;

electrically connecting at least one electrical conductor to said at least one first electrical contact;

mounting said receptacle and said at least one electrical conductor in the floor such that said first substantially flat surface is substantially coplanar with a surface of the floor;

placing a sensor device in said cavity of said receptacle such that at least one second electrical contact of said sensor device is electrically connected to said at least one electrical contact of said receptacle, a second substantially flat surface of said sensor device being substantially coplanar with said first substantially flat surface of said receptacle;

detachably and removably securing said sensor device to said receptacle; and removing said sensor device from said receptacle after said sensor device becomes at least one of damaged and defective, wherein said receptacle remains mounted in the floor throughout said removing step.

19. The method of claim 18, comprising the further step of installing a replacement sensor device in said cavity of said receptacle.

* * * * *